US008279248B2

(12) United States Patent
Moto et al.

(10) Patent No.: US 8,279,248 B2
(45) Date of Patent: Oct. 2, 2012

(54) RECORDING HEAD AND RECORDING APPARATUS PROVIDED THEREWITH

(75) Inventors: Yoichi Moto, Kirishima (JP); Jun Komori, Urayasu (JP); Hidenobu Nakagawa, Kirishima (JP); Kenji Miyamura, Kirishima (JP); Yoshira Niwa, Kirishima (JP); Masaaki Kitado, Kirishima (JP); Ayumi Imamura, Kirishima (JP)

(73) Assignee: Kyocera Corporation, Kyoto (JP)

( * ) Notice: Subject to any disclaimer, the term of this patent is extended or adjusted under 35 U.S.C. 154(b) by 193 days.

(21) Appl. No.: 12/680,727

(22) PCT Filed: Sep. 28, 2008

(86) PCT No.: PCT/JP2008/067572
§ 371 (c)(1),
(2), (4) Date: Jun. 8, 2010

(87) PCT Pub. No.: WO2009/041672
PCT Pub. Date: Apr. 2, 2009

(65) Prior Publication Data

US 2010/0271454 A1 Oct. 28, 2010

(30) Foreign Application Priority Data

Sep. 28, 2007 (JP) ..... 2007-253772
Apr. 24, 2008 (JP) ..... 2008-113492

(51) Int. Cl.
*B41J 2/35* (2006.01)

(52) U.S. Cl. ..... 347/211

(58) Field of Classification Search ..... 347/211, 347/208–209, 204–206, 56–58, 62
See application file for complete search history.

(56) References Cited

FOREIGN PATENT DOCUMENTS

JP 01215561 A 8/1989
JP 2005153512 A 6/2005

OTHER PUBLICATIONS

Chinese language office action dated May 18, 2011 and its English language translation for corresponding Chinese application 200880109031.3.
Chinese language office action dated Aug. 18, 2011 and its English language translation for corresponding Chinese application 200880109031.3.
Japanese language office action dated Aug. 17, 2010 and its English language translation for corresponding Japanese application 2009534449.

*Primary Examiner* — Kristal Feggins
(74) *Attorney, Agent, or Firm* — DLA Piper LLP (US)

(57) ABSTRACT

A thermal head includes heat generating parts and a conductive layer having connecting parts electrically connected to ends of the heat generating parts. The conductive layer has wiring parts whose cross-sectional areas are smaller than cross-sectional areas of the respective connecting parts in directions. The wiring parts has a first upper layer and a second upper layer which have smaller widths in arrow directions than widths of the respective connecting parts as well as a first lower layer and a second lower layer which have lengths not shorter than the widths of the respective connecting parts and greater than the widths of the respective upper layers. The respective upper layers and the respective lower layers are arranged to overlap each other.

14 Claims, 14 Drawing Sheets

RECORDING HEAD AND RECORDING APPARATUS PROVIDED THEREWITH

CROSS REFERENCE TO RELATED APPLICATION

This application is a national stage of international application No. PCT/JP2008/067572 filed on Sep. 28, 2008, which also claims priority to and the benefit of Japanese Patent Application No. 2007-253772 filed Sep. 28, 2007 and Japanese Patent Application No. 2008-113492 filed Apr. 24, 2008, the entire content of which are incorporated herein by reference.

TECHNICAL FIELD

The present invention relates to a recording head such as a thermal head and an ink-jet head, which is used as a printing device in a facsimile, a barcode printer, a video printer, a digital photo printer etc., and a recording apparatus provided with the same.

BACKGROUND ART

There is a thermal printer including a thermal head in which a plurality of heat generating parts are arranged and formed and a transport mechanism transporting a recording medium to the heat generating parts of the thermal head, and forming an image by transferring the heat generated in each heat generating part to the recording medium such as heat sensitive paper in accordance with a signal input to the thermal head (see, for example, Patent Document 1). The heat generating parts of the thermal head mounted on the thermal printer structured as described above are electrically connected to a conductive pattern, and are supplied with power according to an intended image via the conductive pattern.

However, in the thermal head described above, the heat generated in the heat generating parts is dissipated via the conductive pattern. As a result, in the thermal head described above, sometimes the heat generated in the heat generating parts is not transferred effectively to the recording medium. To transfer the required amount of heat to the recording medium in the thermal head described above, the amount of heat generated in the heat generating parts has to be increased excessively, resulting in a considerable amount of power consumption. Therefore, a thermal head in which the width of a conductive pattern in a plan view near a heat generating part is made narrow compared to other parts in order to prevent dissipation via the conductive pattern has been developed (see, for example, Patent Documents 2 and 3).

Patent Document 1: Japanese Unexamined Patent Publication JP-A 53-016638 (1978)

Patent Document 2: Japanese Unexamined Utility Model Publication JP-U 54-122728 (1979)

Patent Document 3: Japanese Unexamined Patent Publication JP-A 2000-62230

DISCLOSURE OF INVENTION

Technical Problem

An object of the invention is to provide a recording head which can enhance electrical reliability while making effective use of the heat generated in a heat generating part, and a recording apparatus provided with the recording head.

Solution to Problem

A recording head of the invention comprises a substrate, a plurality of heat generating parts arranged on the substrate, and a conductive layer electrically connected to each of the heat generating parts.

The conductive layer includes a connecting part and a wiring part. The connecting part is electrically connected to the heat generating part. The wiring part is electrically connected to the connecting part, and has a smaller cross-sectional area along an arrangement direction of the heat generating parts, than a cross-sectional area of the connecting part along the arrangement direction of the heat generating parts.

The wiring part includes a first part and a second part. The first part has a smaller width in a plan view along the arrangement direction of the heat generating parts, than a width of the connecting part in a plan view along the arrangement direction of the heat generating parts. The second part is located in such a way as to overlap with the first part, and has a greater width in a plan view along the arrangement direction of the heat generating parts, than a width of the first part in the plan view along the arrangement direction of the heat generating parts.

The invention further comprises a recording apparatus provided with the recording head described above and a transport mechanism that transports a recording medium.

Advantageous Effects of Invention

A recording head of the invention includes a connecting part having a conductive layer electrically connected to a heat generating part and a wiring part whose cross-sectional area along the arrangement direction of the heat generating parts is small compared to the connecting part. As a result, in the recording head, the heat generated in the heat generating parts is hard to be transferred to the wiring part. Consequently, in the recording head, it is possible to reduce dissipation of the heat generated in the heat generating parts via the wiring part. This makes it possible to make effective use of the heat generated in the heat generating parts.

The wiring part in the recording head includes a first part whose width in a plan view is smaller than the width of the connecting part in a plan view and a second part located in such a way as to overlap with the first part and having a greater width in the plan view than the width of the first part in the plan view. As a result, in the recording head, even when cracks or the like appear in a region in which the first part and the second part overlap, the region on which pressing force is likely to act when the pressing force is exerted on an area near the heat generating parts by a platen or the like, it is possible to ensure predetermined electrical conduction in a region of the second part, the region in which the second part lies off the first part in the plan view. Consequently, in the recording head, it is possible to enhance electrical reliability in the wiring part.

BRIEF DESCRIPTION OF DRAWINGS

FIG. 6C is a sectional view taken on line VIc-VIc shown in. FIG. 5, and FIG. 6D is a sectional view taken on line VId-VId shown in FIG. 5.

REFERENCE SIGNS LIST

Figure 1:
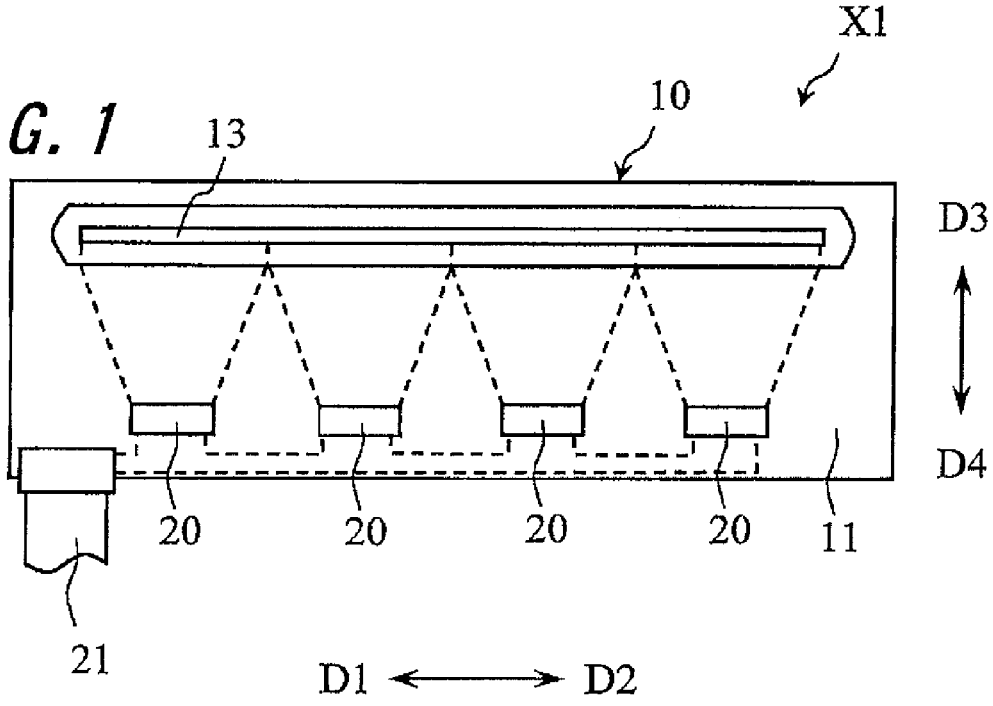
FIG. 1 is a plan view showing a schematic structure of a thermal head X1 which is an example of an embodiment of a recording head of the invention.

X1, X2 thermal head
Y Thermal printer
11 Substrate
12 Thermal storage layer
13 Resistor layer
131 Heat generating part
14 Conductive layer
141 First conductive layer
141*a* First lower layer
141*b* First upper layer
1411 First connecting part.
1412 First wiring part
1413A First transmitting part
142 Second conductive layer
142*a* Second lower layer
142*b* Second upper layer
1421 Second connecting part
1422 Second wiring part
1423 Common connecting part
30 Transport mechanism
P Recording medium
T Thickness of conductive layer
$L_H$ Length of heat generating part in plan view
$W_H$ Width of heat generating part in plan view
$W_{11}$ Width of first connecting part in plan view
$W_{11a}$ Width of first lower layer in plan view in part corresponding to first connecting part
$W_{12a}$ Width of first lower layer in plan view in part corresponding to first wiring part
$W_{11b}$ Width of first upper layer in plan view in part corresponding to first connecting part
W12*b* Width of first upper layer in plan view in part corresponding to first wiring part
$W_{21}$ Width of second connecting part in plan view
W21*a* Width of second lower layer in plan view in part corresponding to second connecting part
W21*b* Width of second upper layer in plan view in part corresponding to second connecting part
W22*a* Width of second lower layer in plan view in part corresponding to second wiring part
W22*b* Width of second upper layer in plan view in part corresponding to second wiring part

BEST MODE FOR CARRYING OUT THE INVENTION

<First Embodiment>

A thermal head X1 shown in FIG. 1 includes a base 10, a driving IC 20, and an external connection member 21.

Figure 2A:
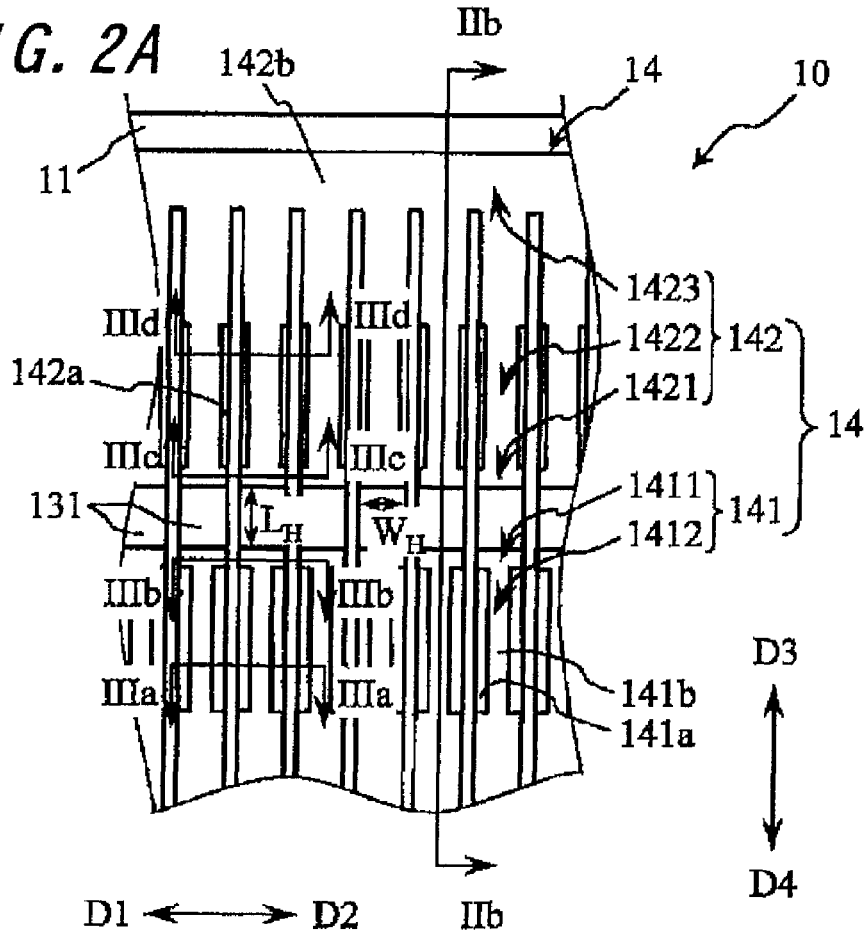
FIG. 2A is a plan view of an enlarged main part of a base shown in FIG. 1.
Figure 2B:
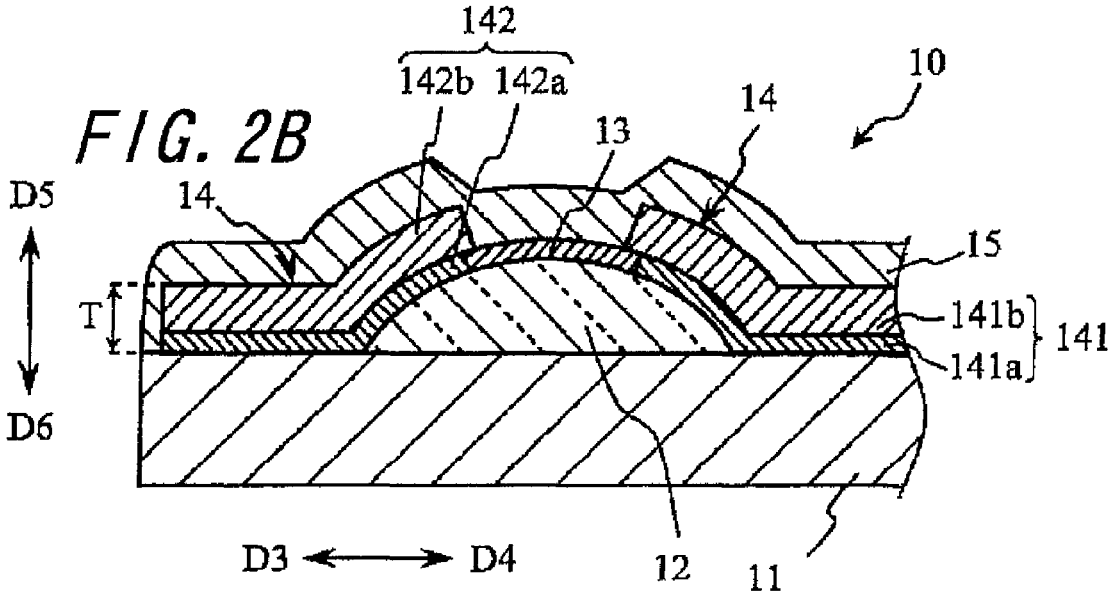
FIG. 2B is a sectional view taken on line IIb-IIb shown in FIG. 2A.

As shown in FIGS. 2A and 2B, the base 10 includes a substrate 11, a thermal storage layer 12, a resistor layer 13, a conductive layer 14, and a protective layer 15. Incidentally, in FIG. 2A, the protective layer 15 is omitted.

The substrate 11 has the function of supporting the thermal storage layer 12, the resistor layer 13, the conductive layer 14, the protective layer 15, and the driving IC 20. The substrate 11 is formed of an electrical insulating material, for example, in a rectangular shape extending in the directions of arrows D1 and D2 in a plan view. Here, the "electrical insulating material" is a material that resists the flow of electricity and has a resistivity of $1.0\times10^{12}$ [Ω·cm] or more, for example. Examples of such an electrical insulating material include ceramic such as alumina ceramic, a resin material such as epoxy-based resin and silicon-based resin, a silicon material, and a glass material. Alumina ceramic is the preferred material for the substrate 11.

The thermal storage layer 12 has the function of temporarily storing part of the heat generated in heat generating parts 131, which will be described later, of the resistor layer 13. That is, the thermal storage layer 12 improves the thermal response characteristics of the thermal head X1 by shortening the time required to raise the temperature of the heat generating parts 131. The thermal storage layer 12 is located on the substrate 11, and is formed in the shape of a band extending in the directions of arrows D1 and D2. The thermal storage layer 12 has a virtually semielliptical cross-sectional shape in the orthogonal direction orthogonal to the directions of arrows D1 and D2. Examples of the material forming the thermal storage layer 12 include a material with lower heat conductivity than the substrate 11. Examples of such a material include a resin material such as epoxy-based resin and polyimide-based resin and a glass material.

The resistor layer 13 is located on the thermal storage layer 12, and is electrically connected to the conductive layer 14. Examples of the material forming the resistor layer 13 include an electrical resistance material with higher resistivity than the conductive layer 14. Examples of the electrical resistance material include a TaN-based material, a TaSiO-based material, a TaSiNO-based material, a TiSiO-based material, a TiSiCO-based material, and a NbSiO-based material. The resistor layer 13 includes the heat generating parts 131 generating heat when a voltage is applied from the conductive layer 14.

The heat generating parts 131 are configured to generate heat ranging from 200° C. or more to 450° C. ox less, for example, as a result of the voltage being applied from the conductive layer 14. Above the thermal storage layer 12, the heat generating parts 131 are placed in a line in the main scanning directions (in the longitudinal direction of the substrate 11) D1 and D2 in the thermal head X1.

Each of the heat generating parts 131 is formed in a rectangular shape in a plan view, the rectangular shape whose width WH in a plan view along the main scanning directions D1 and D2 and length LH in a plan view along the sub scanning directions (the lateral direction of the substrate 11) D3 and D4 are almost the same. The width WH in a plan view ranges from 5.2 [μm] or more to 76 [μm] or less, for example. The length LH in a plan view ranges from 12 [μm or more to 175 [μm] or less, for example. Here, the term "almost the same" covers the common production error range, and an example of the range is the range of error within 10 [%] with respect to the average value of the dimensions of each part. Here, the term "in a plan view" refers to looking in the direction of an arrow D6.

The conductive layer 14 has the function of applying a voltage to the heat generating parts 131. The conductive layer 14 includes a first conductive layer 141 located on the side along the direction of an arrow D4 and a second conductive layer 142 located on the side along the direction of an arrow D3. The thickness T of the conductive layer 14 (141, 142) is configured so as to be nearly uniform as a whole. For this reason, the cross-sectional area in each part of the conductive layer 14 along the directions of arrows D1 and D2 depends on the width in a plan view along the directions of arrows D1 and D2 in each part. Here, the term "the cross-sectional area along the directions of arrows D1 and D2" is the cross-sectional area in the thickness direction along the directions of arrows D1 and D2; for example, is the area in a section (a section in the thickness direction of the substrate 11) defined by arrows D3 and D4-arrows D5 and D6.

The first conductive layer 141 includes a first connecting part 1411 and a first wiring part 1412.

The first connecting part 1411 has one end electrically connected to one end of the heat generating part 131 on that side thereof facing in the direction of an arrow D4. The first connecting part 1411 is so configured that the width $W_{11}$ thereof in a plan view along the directions of arrows D1 and D2 is almost the same as the width $W_H$ of the heat generating part 131 in a plan view (see FIGS. 2A and 3B).

Figure 3A:
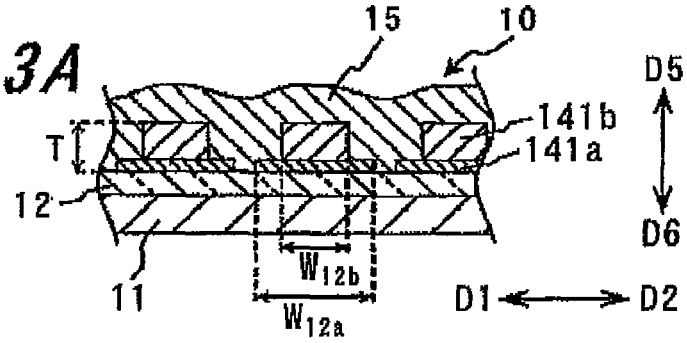
FIG. 3A is a sectional view taken on line IIIa-IIIa shown in FIG. 2A.

The first wiring part 1412 has one end electrically connected to the other end of the first connecting part 1411 and the other end electrically connected to the driving IC 20. The first wiring part 1412 extends, in the direction of an arrow D4, from the central portion of the first connecting part 1411 in the directions of arrows D1 and D2. Moreover, the first wiring part 1412 is so configured that the cross-sectional area along the directions of arrows D1 and D2 is smaller than the cross-sectional area of the first connecting part 1411 along the directions of arrows D1 and D2 (see FIGS. 2A and 3A).

The first conductive layer 141 also includes a first lower layer 141*a* and a first upper layer 141*b*, and part of the first lower layer 141*a* lies off the first upper layer 141*b* in a plan view.

Although part of the first lower layer 141*a* is located on the thermal storage layer 12, most of the first lower layer 141*a* is located on the substrate 11. The first lower layer 141*a* is so configured that the width $W_{11a}$ in a plan view along the directions of arrows D1 and D2 in a part corresponding to the first connecting part 1411 is almost the same as the width $W_{11}$ of the first connecting part 1411 in a plan view. Moreover, the first lower layer 141*a* is so configured that the width $W_{12a}$ in a plan view along the directions of arrows D1 and D2 in a part corresponding to the first wiring part 1412 is equal to or smaller than the width $W_{11}$ of the first connecting part 1411 in a plan view (see FIGS. 2A, 3A, and 3B).

Examples of the material forming the first lower layer 141*a* include a conductive material with lower electric conductivity and heat conductivity than the material for the first upper layer 141*b*. Examples of such a conductive material include a TaN-based material, a TaSiO-based material, a TaSiNO-based material, a TiSiO-based material, a TiSiCO-based material, and a NbSiO-based material.

An entirety of the first upper layer 141*b* is located on the first lower layer 141*a*. When the entirety of the first upper layer 141*b* is located on the first lower layer 141*a*, it is possible to increase the area of contact of the first wiring part 1412 with the thermal storage layer 12.

Figure 3B:
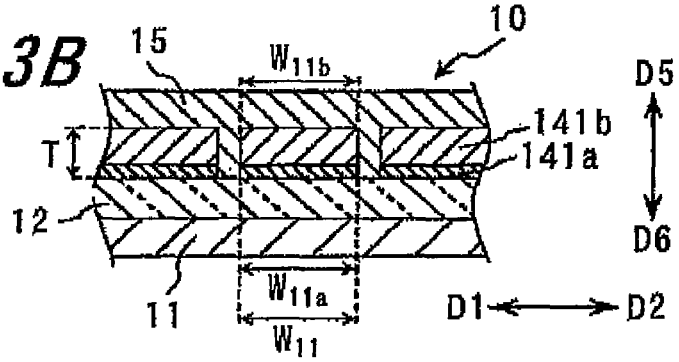
FIG. 3B is a sectional view taken on line IIIb-IIIB shown in FIG. 2A.

The first upper layer 141*b* is so configured that the width $W_{11b}$, in a plan view along the directions of arrows D1 and D2 in a part corresponding to the first connecting part 1411 is almost the same as the width $W_{11}$ of the first connecting part 1411 in a plan view (see FIGS. 2A and 3B). Moreover, the first upper layer 141*b* is so configured that the width $W_{12b}$ in a plan view along the directions of arrows D1 and D2 in a part corresponding to the first wiring part 1412 is smaller than the width $W_{11}$ of the first connecting part 1411 in a plan view and the width $W_{12a}$ of the first lower layer 141*a* in a plan view (see FIGS. 2A, 3A, and 3B).

Examples of the material forming the first upper layer 141*b* include a conductive material containing metal as a chief component. Examples of such a conductive material include aluminum, gold, silver, copper, and an alloy of these metals.

The second conductive layer 142 includes a second connecting part 1421, a second wiring part 1422, and a common connecting part 1423.

The second connecting part 1421 has one end electrically connected to the other end of the heat generating part 131 on that side thereof facing in the direction of an arrow D3. The second connecting part 1421 is so configured that the width $W_{21}$ thereof in a plan view along the directions of arrows D1 and D2 is almost the same as the width $W_H$ of the heat generating part 131 in a plan view (see FIGS. 2A and 3C).

The second wiring part 1422 has one end electrically connected to the other end of the second connecting part 1421, and extends in the direction of an arrow D3 toward the common connecting part 1423 from the central portion of the second connecting part 1421 in the directions of arrows D1 and D2. The second wiring part 1422 is so configured that the cross-sectional area along the directions of arrows D1 and D2 is smaller than the cross-sectional area of the second connecting part 1421 along the directions of arrows D1 and D2 (see FIGS. 2A and 3D).

The common connecting part 1423 is electrically connected to the other end of the second wiring part 1422. The common connecting part 1423 is electrically connected to an unillustrated power source.

The second conductive layer 142 also includes a second lower layer 142*a* and a second upper layer 142*b*, and part of the second lower layer 142*a* lies off the second upper layer 142*b* in a plan view.

Although part of the second lower layer 142*a* is located on the thermal storage layer 12, most of the second lower layer 142*a* is located on the substrate 11. The second lower layer 142*a* is so configured that the width $W_{21a}$ in a plan view along the directions of arrows D1 and D2 in a part corresponding to the second connecting part 1421 is almost the same as the width $W_{21}$ of the second connecting part 1421 in a plan view. Moreover, the second lower layer 142*a* is so configured that the width $W_{22a}$ along the directions of arrows D1 and D2 in a part corresponding to the second wiring part 1422 is equal to or smaller than the width $W_{21}$ of the second connecting part 1421 in a plan view (see FIGS. 2A, 3C, and 3D).

As the material forming the second lower layer 142*a*, a conductive material with lower electric conductivity and heat conductivity than the material for the second upper layer 142*b*, for example, is used. Examples of such a conductive material include a TaN-based material, a TaSiO-based material, a TaSiNO-based material, a TiSiO-based material; a TiSiCO-based material, and a NbSiO-based material.

An entirety of the second upper layer 142*b* is located on the second lower layer 142*a*. When the entirety of the second upper layer 142*b* is located on the second lower layer 142*a*, it is possible to increase the area of contact of the second wiring part 1422 with the thermal storage layer 12.

Figure 3C:
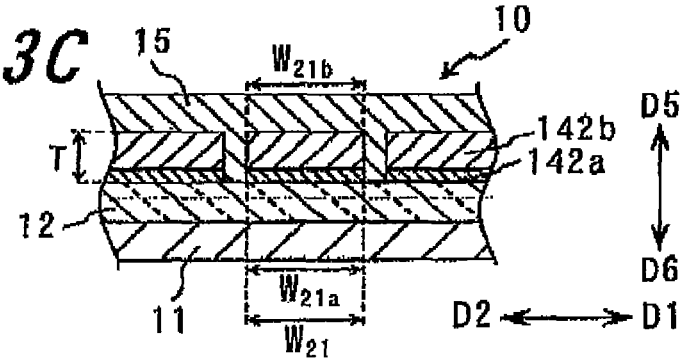
FIG. 3C is a sectional view taken on line IIIc-IIIc shown in FIG. 2A.
Figure 3D:
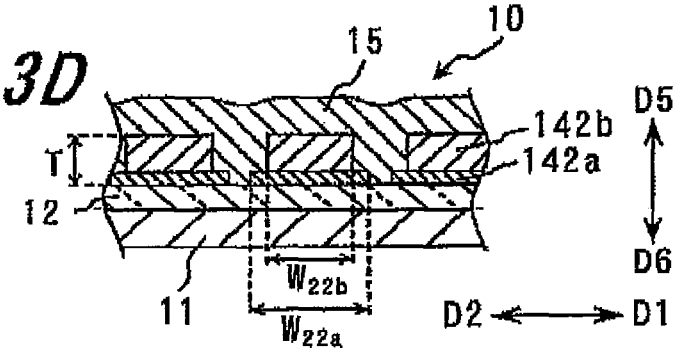
FIG. 3D is a sectional view taken on line IIId-IIId shown in FIG. 2A.

The second upper layer 142*b* is so configured that the width $W_{21b}$ in a plan view along the directions of arrows D1 and D2 in a part corresponding to the second connecting part 1421 is almost the same as the width $W_{21}$ of the second connecting part 1421 in a plan view (see FIGS. 2A and 3C). Moreover, the second upper layer 142*b* is so configured that the width $W_{22b}$ in a plan view along the directions of arrows D1 and D2 in a part corresponding to the second wiring part 1422 is smaller than the width $W_{21}$ of the second connecting part 1421 in a plan view and the width $W_{22a}$ of the second lower layer 142*a* in a plan view (see FIGS. 2A and 3D).

Preferably, the second upper layer 142*b* is so configured that the width $W_{22b}$ in a plan view is greater than the width $W_{12b}$ of the first upper layer 141*b* in a plan view.

Examples of the material forming the second upper layer 142*b* include a conductive material containing metal as a chief component. Examples of such a conductive material include aluminum, gold, silver, copper, and an alloy of these metals.

The protective layer 15 has the function of protecting the heat generating parts 131 and the conductive layer 14. Examples of the material forming the protective layer 15 include an electrical insulating material. Examples of such an electrical insulating material include $SiO_2$, a SiN-based material such as silicon nitride ($Si_3N_4$), a SiNO-based material such as SIALON (Si.Al.O.N), and a SiC-based material.

The driving IC 20 has the function of controlling a power supply state of a plurality of heat generating parts 131. The driving IC 20 is electrically connected to the conductive layer 14 and the external connection member 21. The external connection member 21 has the function of supplying an electrical signal for driving the heat generating parts 131. Examples of the external connection member 21 include flexible printed circuits (Flexible Printed Circuits) and wiring substrates. When such an external connection member 21 and the driving IC 20 are connected, the driving IC 20 can make the heat generating parts 131 generate heat selectively based on the image information supplied via the external connection member 21.

In the thermal head X1 described above, the first and second wiring parts 1412 and 1422 in the conductive layer 14 are so configured that the cross-sectional areas along the directions of arrows D1 and D2 are smaller than those of the first and second connecting parts 1411 and 1421. Consequently, in the thermal head X1, the heat generated in the heat generating parts 131 resists being conveyed to the wiring parts 1412 and 1422, making it possible to reduce dissipation of the heat generated in the heat generating parts 131 in the wiring parts 1412 and 1422. This allows the thermal head X1 to make effective use of the heat generated in the heat generating parts 131.

The conductive layer 14 is so configured that the widths $W_{12a}$ and $W_{22a}$ in a plan view in parts corresponding to the wiring parts 1412 and 1422 in the first and second lower layers 141*a* and 142*a* are greater than the widths $W_{12b}$ and $W_{22b}$ in a plan view in parts corresponding to the wiring parts 1412 and 1422 in the first and second upper layers 141*b* and 142*b*. This makes it possible to ensure predetermined electrical conduction in the lower layers 141*a* and 142*a* by the lower layers 141*a* and 142*a* lying off the upper layers 141*b* and 142*b* even when cracks or the like appear in regions in which the lower layers 141*a* and 142*a* and the upper layers 141*b* and 142*b* overlap, the regions on which pressing force is likely to act when the pressing force is exerted on an area near the heat generating parts 131 by a platen, for example, while making effective use of the heat generated in the heat generating parts 131 in the upper layers 141*b* and 142*b*. Therefore, in the thermal head X1, it is possible to enhance electrical reliability in the wiring parts 1412 and 1422 while making effective use of the heat generated in the heat generating parts 131.

In the conductive layer 14, since the upper layers 141*b* and 142*b* are located on the lower layers 141*a* and 142*a*, the areas of contact of the first and second wiring parts 1412 and 1422 with the thermal storage layer 12 are satisfactorily secured. As a result, in the thermal head X1, it is possible to enhance the adhesion of the wiring parts 1412 and 1422 to the thermal storage layer 12. Therefore, in the thermal head X1, it is possible to reduce the possibility that the first wiring part 1412 or the second wiring part 1422 falls off the thermal storage layer 12, thereby enhancing electrical reliability.

<Second Embodiment>

Figure 4:
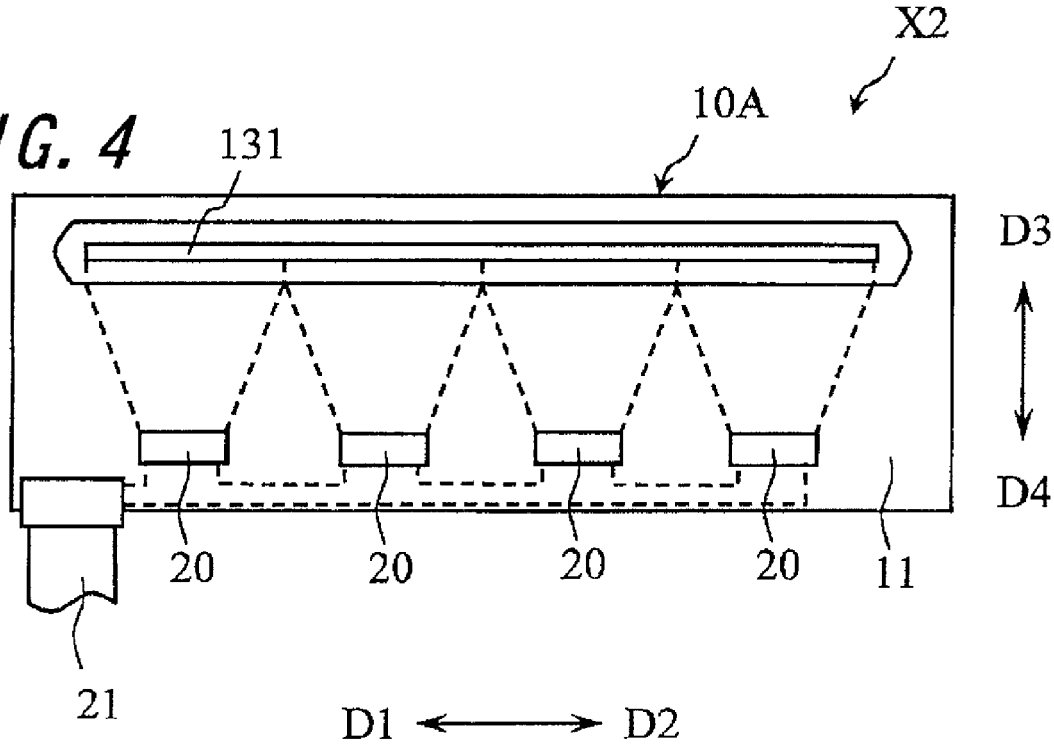
FIG. 4 is a plan view showing a schematic structure of a thermal head X2 which is another example of the embodiment of the recording head of the invention.

A thermal head X2 shown in FIG. 4 differs from the thermal head X1 described earlier with reference to FIGS. 1 to 3 in that a base 10A with a conductive layer 14A (see FIGS. 5 to 9) having a different structure is adopted. On the other hand, the structure of the thermal head X2 is the same as that of the thermal head X1 except for the base 10A (the conductive layer 14A) of the thermal head X2.

As shown in FIGS. 5, 8A, 8B, and 9, the conductive layer 14A includes a first conductive layer 141A and a second conductive layer 142A. Incidentally, in FIG. 5, the protective layer 15 is omitted.

The first conductive layer 141A includes a first connecting part 1411A, a first wiring part 1412A, and a first transmitting part 1413A.

The first connecting part 1411A has one end electrically connected to one end of the heat generating part 131 on that side thereof facing in the direction of an arrow D4. The first connecting part 1411A is so configured that the width $W_{11A}$ in a plan view along the directions of arrows D1 and D2 is almost the same as the width $W_H$ of the heat generating part 131 in a plan view.

The first wiring part 1412A has one end electrically connected to the other end of the first connecting part 1411A and the other end electrically connected to one end of the first transmitting part 1413A. The first wiring part 1412A is so configured that, at the end connected to the first connecting part 1411A, the cross-sectional area along the directions of arrows D1 and D2 is smaller than the cross-sectional area of the first connecting part 1411A along the directions of arrows D1 and D2. On the other hand, the first wiring part 1412A is so configured that the cross-sectional area (see FIG. 6B) along the directions of arrows D1 and D2 at the end connected to the first transmitting part 1413A is greater than the cross-sectional area along the directions of arrows D1 and D2 at the end connected to the first connecting part 1411A and the cross-sectional area (see FIG. 6D) in the first connecting part 1411A along the directions of arrows D1 and D2.

The first transmitting part 1413A has one end electrically connected to the other end of the first wiring part 1412A and the other end electrically connected to the driving IC 20. The cross-sectional area (see FIG. 6A) of the first transmitting part 1413A along the directions of arrows D1 and D2 is greater than the cross-sectional areas of the first wiring part 1412A and the first connecting part 1411A along the directions of arrows D1 and D2.

The first conductive layer 141A also includes a first lower layer 141Aa, a first upper layer 141Ab, and a first middle layer 141Ac, and part of the first lower layer 141Aa lies off the first upper layer 141Ab in a plan view.

Although part of the first lower layer 141Aa is located on the thermal storage layer 12, most of the first lower layer 141Aa is located on the substrate 11. The first lower layer 141Aa is so configured that the width W11Aa in a plan view along the directions of arrows D1 and D2 in a part corresponding to the first connecting part 1411A is almost the same as the width W11A of the first connecting part 1411A in a plan view (see FIGS. 5 and 6D). The first lower layer 141Aa is so configured that the width $W12_a$ in a plan view along the directions of arrows D1 and D2 in a part corresponding to the first wiring part 1412A is equal to or smaller than the width W11A of the first connecting part 1411A in a plan view (see FIGS. 5, 6C, and 6D). The first lower layer 141Aa is so configured that the width W13Aa in a plan view along the directions of arrows D1 and D2 in the first transmitting part 1413A is almost the same as the width W11A of the first connecting part 1411A in a plan view (see FIGS. 5, 6A, and 6D).

Examples of the material forming the first lower layer 141Aa include a conductive material with lower electric conductivity and heat conductivity than the material for the first upper layer 141Ab. Examples of such a conductive material include a TaN-based material, a TaSiO-based material, a TaSiNO-based material, a TiSiO-based material, a TiSiCO-based material, and a NbSiO-based material.

An entirety of the first upper layer 141Ab is located on the first lower layer 141Aa. The first upper layer 141Ab is made uniform in thickness as a whole, and is so configured that the thickness $T_{11A}$, the thickness $T_{12A}$, and the thickness $T_{13A}$ in the first connecting part 1411A, the first wiring part 1412A, and the first transmitting part 1413A, respectively, are almost the same (see FIGS. 6A to 6D, and 9).

Figure 5:
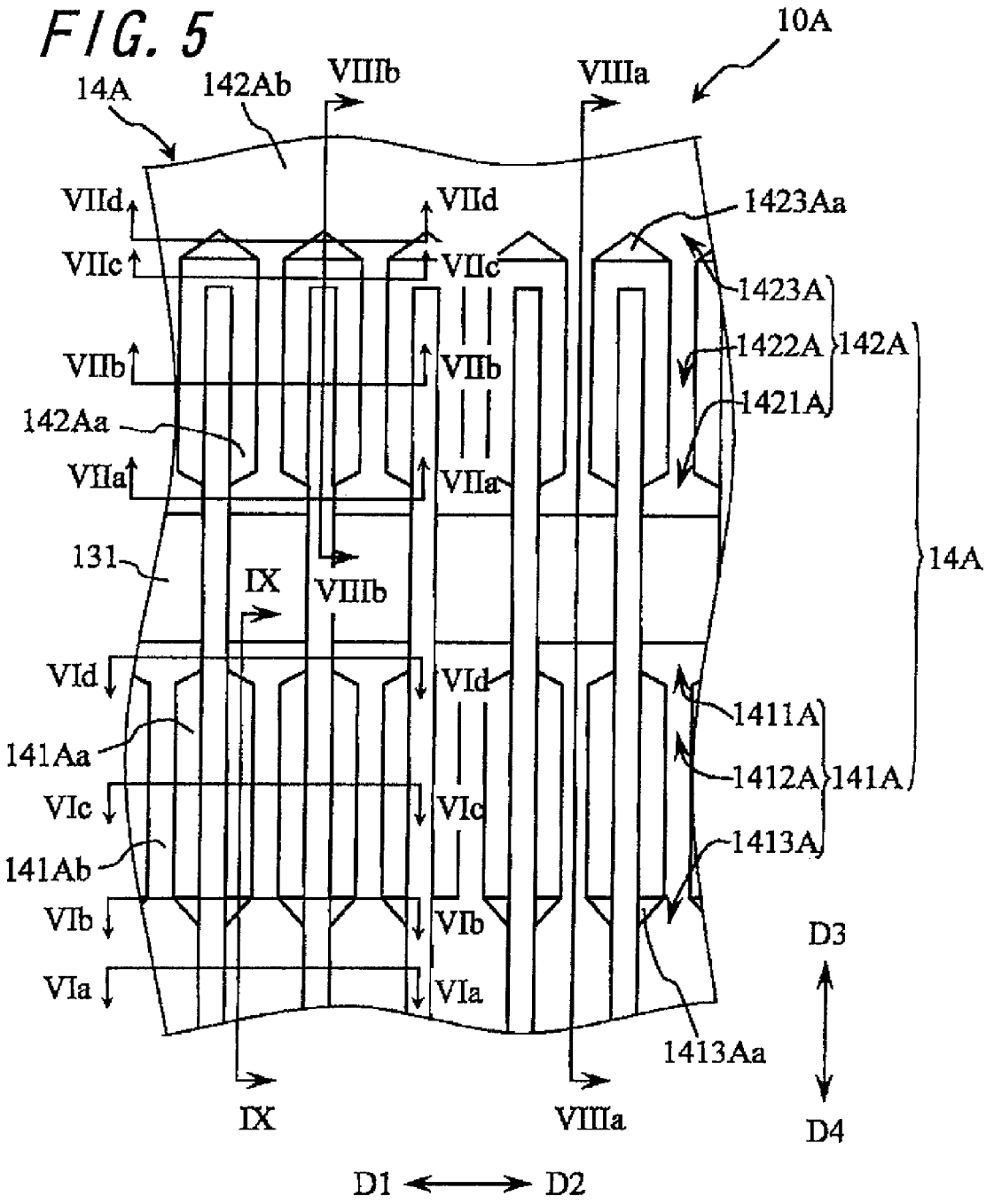
FIG. 5 is a plan view of an enlarged main part of a base shown in FIG. 4.
Figure 6A:
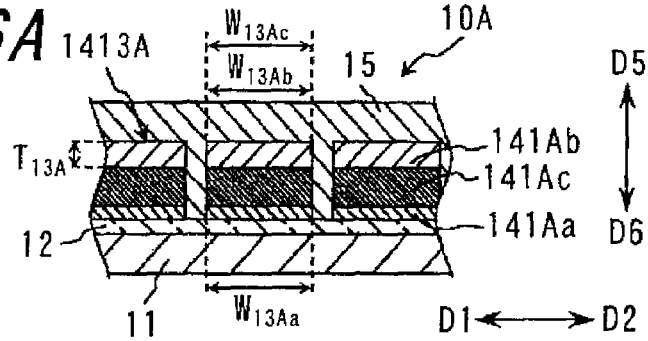
FIG. 6A is a sectional view taken on line VIa-Vla shOwn in FIG. 5.
Figure 6B:
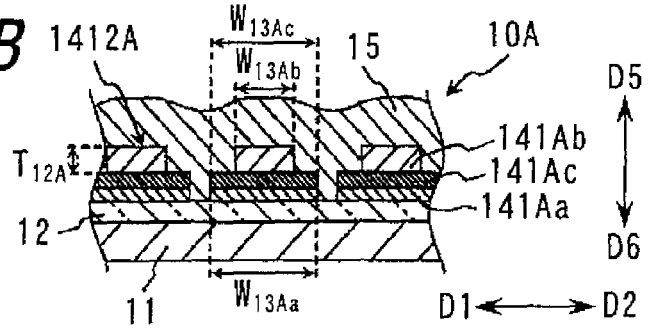
FIG. 6B is a sectional view taken on line VIb-Vib shown in FIG. 5.
Figure 6C:
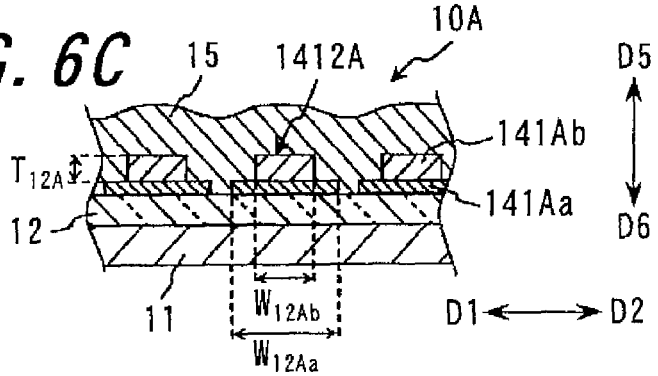
Figure 6D:
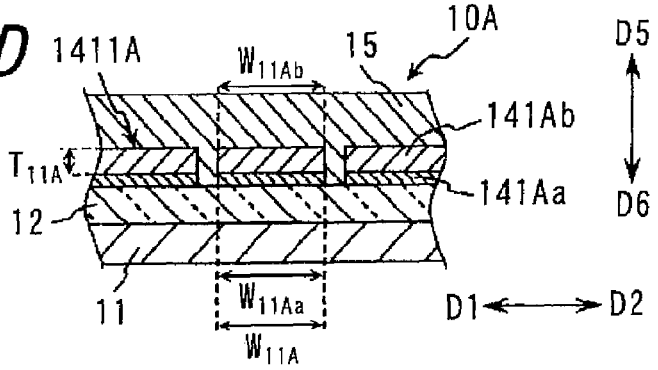

The first upper layer 141Ab is so configured that the width W11Ab in a plan view along the directions of arrows D1 and 02 in the first connecting part 1411A is almost the same as the width W11A of the first connecting part 1411A in a plan view (see FIG. 6D). The first upper layer 141Ab is so configured that the width W12Ab in a plan view along the directions of arrows D1 and D2 in the first wiring part 1412A is equal to or smaller than the width W11A of the first connecting part 1411A in a plan view and the width W12Aa of the first lower layer 141Aa in a plan view (see FIGS. 5, 6C, and 6D). As a result, in the first wiring part 1412A, the first lower layer 141Aa lies off the first upper layer 141Ab. In addition, the first upper layer 141Ab is so configured that the width W13Ab in a plan view along the directions of arrows Dl and D2 in the first transmitting part 1413A is almost the same as the width Wil of the first connecting part 1411A in a plan view (see FIGS. 5, 6A, and 6D).

The width $W_{13Ab}$ of the first upper layer 141Ab in the first transmitting part 1413A is so configured as to become longer with distance from the end connected to the first wiring part 1412A in the direction of an arrow D4 (with distance from the first wiring part 1412A) while it is in a certain area away from the first wiring part 1412A.

Examples of the material forming the first upper layer 141Ab include a conductive material containing metal as a chief component. Examples of such a conductive material include aluminum, gold, silver, copper, and an alloy of these metals.

The first middle layer 141Ac is located between the first lower layer 141Aa and the first upper layer 141Ab in a part corresponding to the first transmitting part 1413A, and does not present in parts corresponding to the first connecting part 1411A and the first wiring part 1412A. Unlike the first transmitting part 1413A, the width W13Ac of the first middle layer 141Ac in a plan view along the directions of arrows D1 and D2 is uniform, and is so configured as to be almost the same as the width W13Aa of the first lower layer 141Aa in a plan view. As a result, the first middle layer 141Ac lies off the first upper layer 141Ab in a region from the end connected to the first wiring part 1412A until the width W13AB in a plan view in a part corresponding to the first transmitting part 1413A in the first upper layer 141Ab becomes almost the same as the width W11A of the first connecting part 1411A in a plan view. The above region 1413Aa in which the first middle layer 141Ac lies off the first upper layer 141Ab becomes thin, in at least part thereof, in the direction of an arrow D3, and is thinner than other regions. Preferably, the region 1413Aa has a low degree of surface roughness compared to the first upper layer 141Ab. Here, the "surface roughness" is, for example, the surface roughness specified in the Japanese Industrial Standards B0601:2001.

Examples of the material forming the first middle layer 141Ac include aluminum, gold, silver, copper, and an alloy of these metals.

The second conductive layer 142A includes a second connecting part 1421A, a second wiring part 1422A, and a common connecting part 1423A.

The second connecting part 1421A has one end electrically connected to the other end of the heat generating part 131 on that side thereof facing in the direction of an arrow D3. The second connecting part 1421A is so configured that the width $W_{21A}$ in a plan view along the directions of arrows D1 and D2 is almost the same as the width $W_H$ of the heat generating part 131 in a plan view.

The second wiring part 1422A has one end electrically connected to the other end of the second connecting part 1421A. The second wiring part 1422A is so configured that the cross-sectional area along the directions of arrows D1 and D2 is smaller than the cross-sectional area of the second connecting part 1421A along the directions of arrows D1 and D2.

The common connecting part 1423A electrically connects the second wiring parts 1422A with each other, and is electrically connected to an unillustrated power source.

The second conductive layer 142A also includes a second lower layer 142Aa, a second upper layer 142Ab, and a second middle layer 142Ac, and part of the second lower layer 142Aa lies off the second upper layer 142Ab in a plan view.

Although part of the second lower layer 142Aa is located on the thermal storage layer 12, most of the second lower layer 142Aa is located on the substrate 11. The width $W_{21Aa}$ in a plan view along the directions of arrows D1 and D2 in a part corresponding to the second connecting part 1421A is so configured as to be almost the same as the width $W_{21A}$ of the second connecting part 1421A in a plan view. The second lower layer 142Aa is so configured that the width $W_{22Aa}$ in a plan view along the directions of arrows D1 and D2 in the second wiring part 1422A is equal to or smaller than the width $W_{21A}$ of the second connecting part 1421A in a plan view.

At the end of the second wiring part 1422A, the end connected to the common connecting part 1423A, the second lower layer 142Aa is connected to another second wiring part 1422A situated next thereto in the directions of arrows D1 and D2.

As the material forming the second lower layer 142Aa, a conductive material with lower electric conductivity and heat conductivity than the material for the second upper layer 142Ab, for example, is used. Examples of such a conductive material include a TaN-based material, a TaSiO-based material, a TaSiNO-based material, a TiSiO-based material, a TiSiCO-based material, and a NbSiO-based material.

An entirety of the second upper layer 142Ab is located on the second lower layer 142Aa. The second upper layer 142Ab is made uniform in thickness as a whole, and is so configured that the thickness T21A, the thickness T22A, and the thickness T23 A in the second connecting part 1421A, the second wiring part 1422A, and the common connecting part 1423A, respectively, are almost the same (see FIGS. 7A to 7D, and 8B).

Figure 7A:
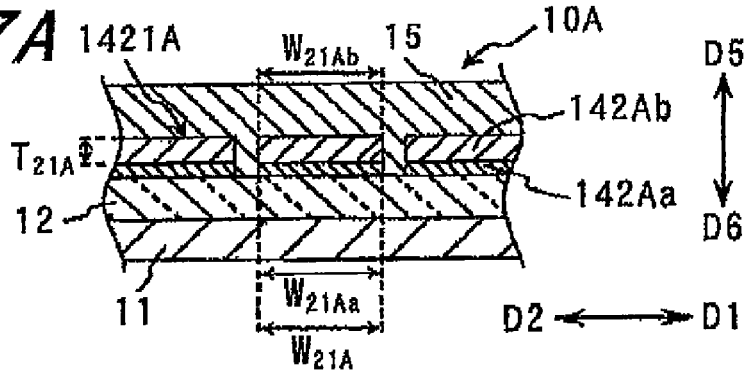
FIG. 7A is a sectional view taken on line VIIa-VIIa shown in FIG. 5.
Figure 7B:
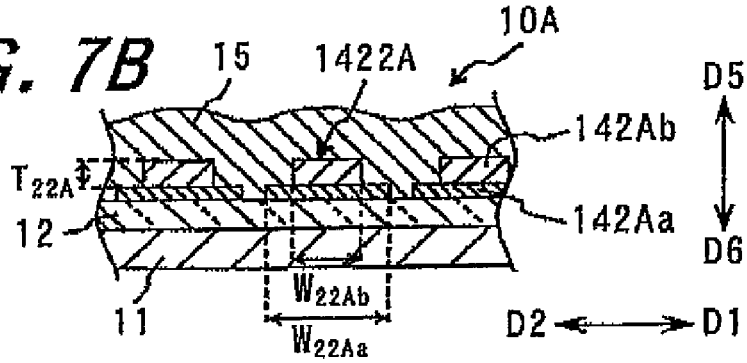
FIG. 7B is a sectional view taken on line VIIb-VIIb shown in FIG. 5.
Figure 7C:
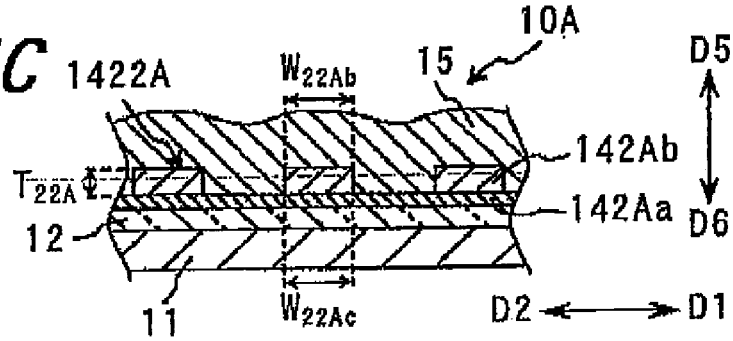
FIG. 7C is a sectional view taken on line VIIc-VIIc shown in FIG. 5.
Figure 7D:
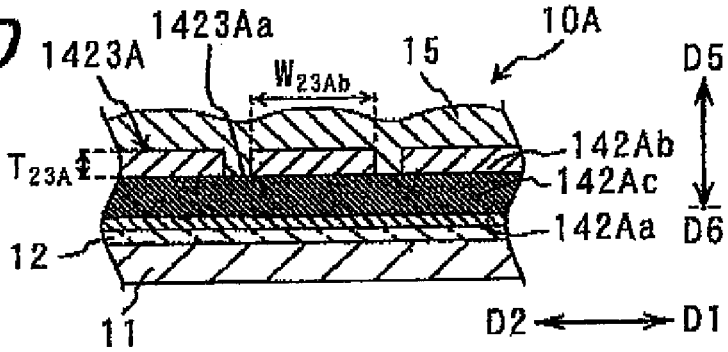
FIG. 7D is a sectional view taken on line VIId-VIId shown in FIG. 5.
Figure 8A:
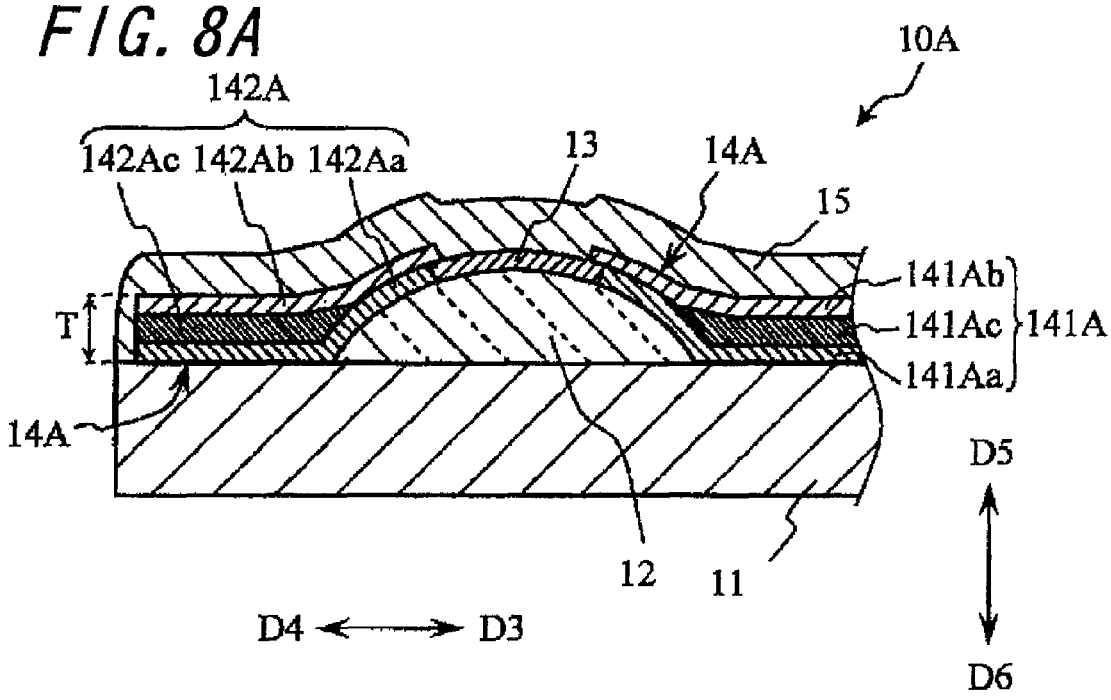
FIG. 8A is a sectional view taken on line VIIIa-VIIIa shown in FIG. 5.
Figure 8B:
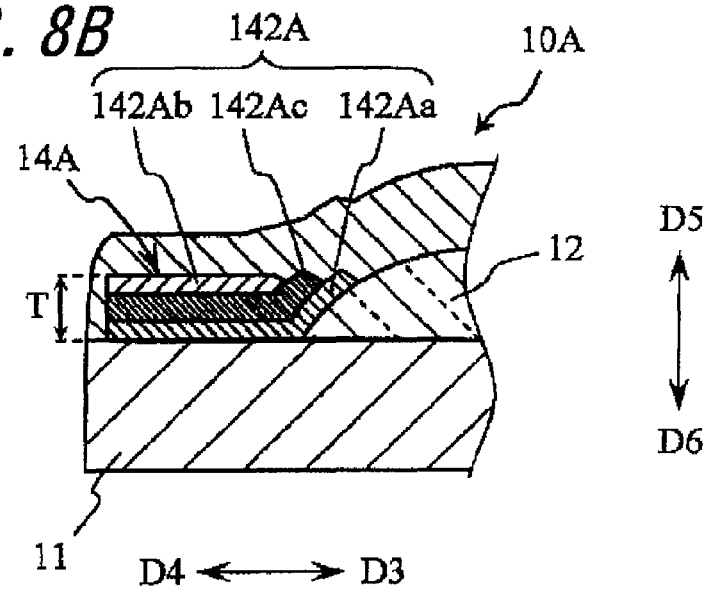
FIG. 8B is a sectional view taken on line VIIIb-VIIIb shown in FIG. 5.
Figure 9:
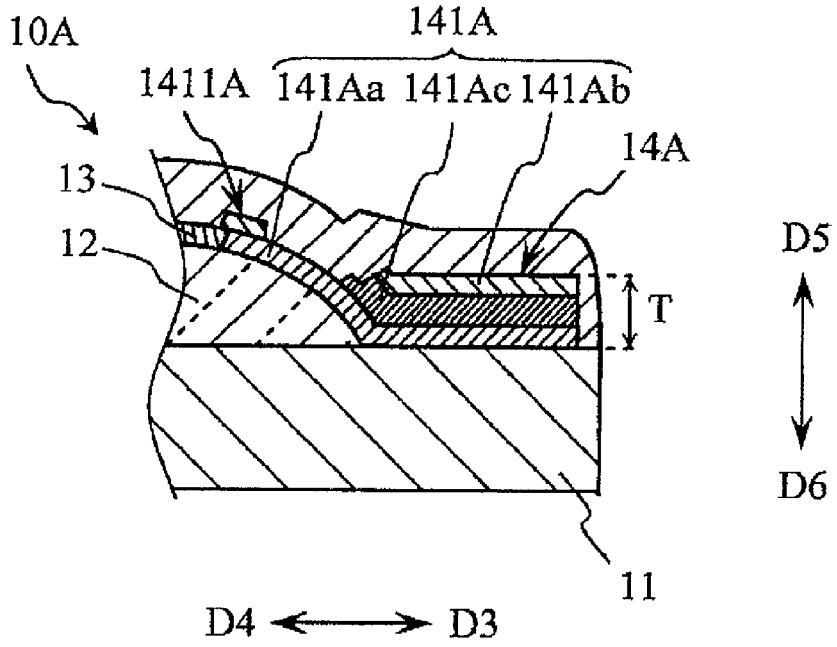
FIG. 9 is a sectional view taken on line IX-IX shown in FIG. 5.

The second upper layer 142Ab is so configured that the width W21Ab in a plan view along the directions of arrows D1 and 1D2 in a part corresponding to the second connecting part 1421A is almost the same as the width W21A of the second connecting part 1421A in a plan view (see FIGS. 5 and 7A). The second upper layer 142Ab is so configured that the width W22Ab in a plan view along the directions of arrows D1 and D2 in a part corresponding to the second wiring part 1422A is smaller than the width 1421A of the second connecting part 1421A in a plan view and the width W22Aa in a plan view in the second wiring part 1422A of the second lower layer 142Aa (see FIGS. 5, 7A, and 7B). As a result, in the second wiring part 1422A, the second lower layer 142Aa lies off the second upper layer 142Ab.

Preferably, the second upper layer 142Ab is so configured that the width $W_{22Ab}$ in a plan view is greater than the width $W_{12Ab}$ of the first upper layer 141Ab in a plan view.

In addition, the second upper layer 142Ab is so configured that the width $W_{23Ab}$ in a plan view along the directions of arrows D1 and D2 in a part corresponding to the common connecting part 1423A becomes longer with distance from the end connected to the second wiring part. 1422A in the direction of an arrow D3 (with distance from the second wiring part 1422A) while it is in a certain area away from the second wiring part 1422A.

Examples of the material forming the second upper layer 142Ab include a conductive material containing metal as a chief component. Examples of such a conductive material include aluminum, gold, silver, copper, and an alloy of these metals.

The second middle layer 142Ac is located between the second lower layer 142Aa and the second upper layer 142Ab in a part corresponding to the common connecting part 1423A, and does not present in parts corresponding to the second connecting part 1421A and the second wiring part 1422A. An end of the second middle layer 142Ac, the end facing in the direction of an arrow D4 in the common connecting part 1423A, lies along the directions of arrows D1 and D2. As a result, in this embodiment, the second middle layer 142Ac lies off the second upper layer 142Ab in a region until the ends of the common connecting part 1423A, the ends connected to the second wiring parts 1422A, are connected to each other in the second upper layer 142Ab. Moreover, the above region 1423Aa in which the second middle layer 142Ac lies off the second upper layer 142Ab is thinner than other regions such as the second wiring part 1422A in the second upper layer 142Ab. Furthermore, the region 1423Aa has a low degree of surface roughness compared to the second upper layer 142Ab. Also, the region 1423Aa has a larger area in a plan view compared to the region 1413Aa. In addition, in this embodiment, part of the second middle layer 142Ac located between the regions 1423Aa is so configured as to become thin in the direction of an arrow D4.

Examples of the material forming the second middle layer 142Ac include aluminum, gold, silver, copper, and an alloy of these metals.

In the thermal head X2, a plurality of second wiring parts 1422A are provided, and the second conductive layer 142A further includes the common connecting part 1423A connected to the plurality of second wiring parts 1422A. On the other hand, at the end connected to the common connecting parts 1423A, the second lower layer 142Aa of the second wiring part 1422A and the second lower layer 142Aa of the another second wiring part 1422A situated next thereto in the directions of arrows D1 and D2 are connected to each other. This makes it possible to reduce a difference in level in a region in which the second wiring part 1422A and the common connecting part 1423A are connected. In the thermal head X2, it is possible to form the protective layer 15 satisfactorily even when the protective layer 15 is provided in such a way as to lie astride a plurality of second wiring parts 1422A and the common connecting part 1423A. Consequently, in the thermal head X2, it is possible to protect the heat generating parts 131 and the conductive layer 14 satisfactorily.

Furthermore, in the thermal head X2, the thickness in the end at which the common connecting part 1423A is connected to the second wiring part 1422A is smaller than the thickness of a region in which the common connecting part 1423A is connected to the second wiring part 1422A in the second upper layer 142Ab. As a result, it is possible to reduce a difference in level in a region in which the second wiring part 1422A and the common connecting part 1423A are connected. Consequently, in the thermal head X2, it is possible to form the protective layer 15 satisfactorily even when, for example, the protective layer 15 is provided so as to lie astride a plurality of second wiring parts 1422A and the common connecting part 1423A. Therefore, in the thermal head X2, it is possible to protect the heat generating parts 131 and the conductive layer 14 satisfactorily.

The thermal head X2 further includes a plurality of first transmitting parts 1413A each having one end connected to the other end of the first wiring part 1412A. The cross-sectional area of the first wiring part 1412A along the directions of arrows D1 and D2 at the end connected to the first connecting part 1411A is smaller than the cross-sectional area along the directions of arrows D1 and D2 at the end of the first connecting part 1411A, the end connected to the heat generating part 131, and the cross-sectional area thereof along the directions of arrows D1 and D2 at the end connected to the first transmitting part 1413A is greater than the cross-sectional area along the directions of arrows D1 and D2 at the end of the first connecting part 1411, the end connected to the heat generating part 131. The first transmitting part 1413A includes, at the end connected to the first wiring part 1412A, the first lower layver 141Aa having the width $W13A_a$ in a plan view, the width $W13_{Aa}$ greater than the width W12*a* in a plan view in a part corresponding to the first wiring part 1412A, and the first upper layer 141Ab located on the first lower layer 141Aa and having the width W13Ab in a plan view, the width W13Ab which is almost the same as the width W12Ab in a plan view in the first wiring part 1412A. Consequently, in the thermal head X2, it is possible to reduce a difference in level in a region in which the first wiring part 1412A and the first transmitting part 1413A are connected, making it possible to form the protective layer 15 satisfactorily even when, for example, the protective layer 15 is provided so as to lie astride a plurality of first wiring parts 1412A and first transmitting parts 1413A. Therefore, in the thermal head X2, it is possible to protect the heat generating parts 131 and the conductive layer 14 satisfactorily.

In the thermal head X2, since, in the second conductive layer 142A, the region 1423Aa has a low degree of surface roughness compared to the surface roughness of the second upper layer 142Ab, it is possible to reduce the degree of surface-roughness of the protective layer 15 provided on the second upper layer 142Ab. Consequently, in the thermal head X2, it is possible to reduce the friction on the region 1423Aa located at the corner where pressing force becomes relatively great when a recording medium, for example, is pressed against the thermal head X2, and slide. the recording medium satisfactorily. As a result, in the thermal head X2, is possible to transport the recording medium satisfactorily, and reduce the possibility that the residues of the recording medium adhere to the region 1423Aa located at the corner.

In the thermal head X2, since, in the first conductive layer 141A, the region 1413Aa has a low degree of surface roughness compared to the surface roughness of the first upper layer 141Ab, it is possible to reduce the degree of surface roughness of the protective layer 15 provided on the first upper layer 141Ab. Consequently, in the thermal head X2, it is possible to reduce the friction on the region 1413Aa located at the corner where pressing force becomes relatively great when a recording medium, for example, is pressed against the thermal head X2, and slide the recording medium satisfactorily. As a result, in the thermal head X2, it is possible to transport the recording medium satisfactorily, and reduce the possibility that the residues of the recording medium adhere to the region 1413Aa located at the corner.

In the thermal head X2, since the area of the region 1423Aa is greater than the area of the region 1413Aa in width in a plan view, even when, for example, a recording medium is transported, while being slid, in the direction of an arrow D3, it is possible to reduce the friction satisfactorily on the region 1413Aa extending in the directions of arrows D1 and D2, the directions intersecting with the direction of transportation.

<Printer>

Figure 10:
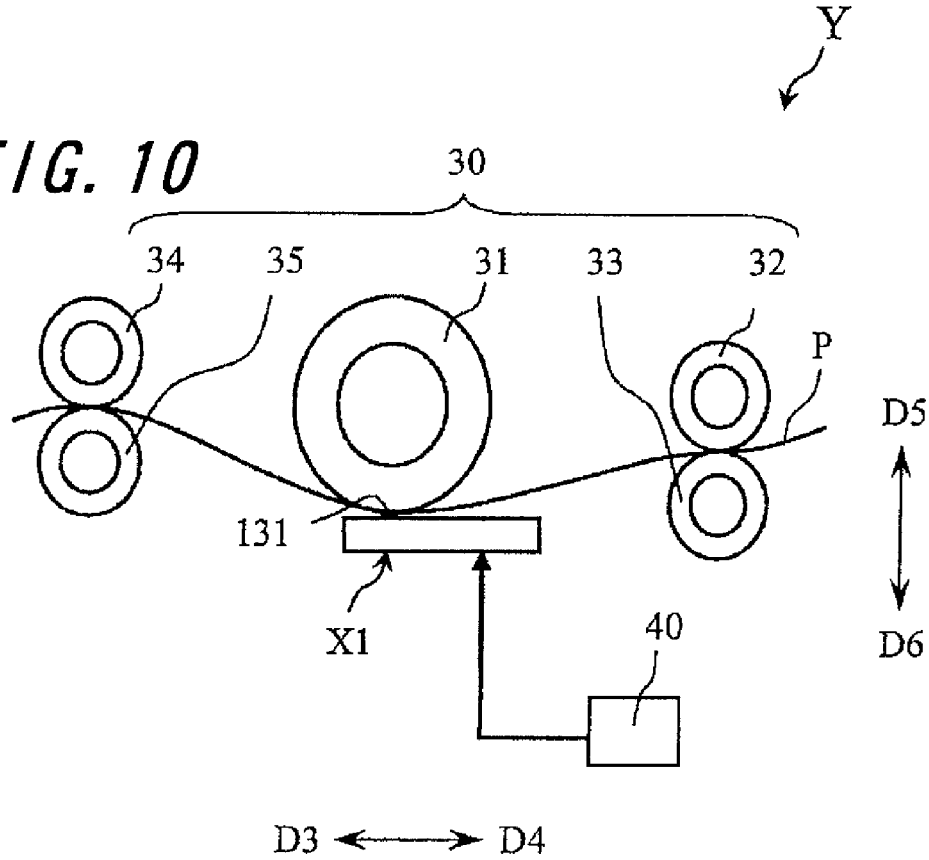
FIG. 10 is an overall view showing a schematic structure of a thermal printer which is an example of an embodiment of a recording apparatus of the invention.

FIG. 10 is an overall view showing a schematic structure of a thermal printer Y according to this embodiment.

The thermal printer Y includes the thermal head X1, a transport mechanism 30, and driving means 40, and performs printing on a recording medium P transported in the direction of an arrow D3.

Incidentally, in this embodiment, the thermal head X1 is adopted as a thermal head; however, the thermal head X2 may be adopted in place of the thermal head X1.

Here, examples of the recording medium P include thermal recording paper or a thermal film having a surface whose density varies by the application of heat and a medium forming an image by transferring an ink component of an ink film, the ink component melted by heat conduction, to transfer paper.

The transport mechanism 30 has the function of bringing the recording medium P into contact with the heat generating parts 131 of the thermal head X1 while transporting the recording medium P in the direction of an arrow D3. The transport mechanism 30 includes a platen 31 and transportation rollers 32, 33, 34, and 35.

The platen 31 has the function of pressing the recording medium P against the heat generating parts 131. The platen 31 is rotatably supported while being in contact with a part of the protective layer 15, the part located above the heat generating parts 131. The platen 31 has a structure made up of a cylindrical base having an outer surface covered with an elastic member. The base is made of metal such as stainless steel. The elastic member is made of butadiene rubber having a thickness ranging from 3 [mm] or more to 15 [mm] or less, for example.

The transportation rollers 32, 33, 34, and 35 have the function of transporting the recording medium P. That is, the transportation rollers 32, 33, 34, and 35 feed the recording medium P into the space between the heat generating parts 131 of the thermal head X1 and the platen 31, and pull the recording medium P out of the space between the heat generating parts 131 of the thermal head X1 and the platen 31. These transportation rollers 32, 33, 34, and 35 may be formed of a metal cylindrical member, for example, or, as is the case with the platen 31, may have a structure made up of a cylindrical base having an outer surface covered with an elastic member, for example.

The driving means 40 has the function of supplying image information to the driving IC 20. That is, the driving means 40 supplies the image information for selectively driving the heat generating parts 131 to the driving IC 20 via the external connection member 21.

Since the thermal printer Y is provided with the thermal head X1, the thermal printer Y can enjoy the effects achieved by the thermal head X1. In other words, the thermal printer Y can enhance electrical reliability while making effective use of the heat generated in the heat generating parts 131.

Moreover, the thermal head X1 is so configured that the cross-sectional area of the first wiring part 1412 is smaller than the cross-sectional area of the second wiring part 1422. As a result, in the thermal head X1, it is possible to shift the position of a heat spot of the thermal head X1 from the center of the heat generating part 131 in the direction of an arrow D4, for example. Consequently, in the thermal printer Y, even when transfer is performed by pressing, as the recording medium P, an ink ribbon and plain paper, for example, against the heat generating parts 131, it is possible to perform transfer on the plain paper after melting the ink adequately by shifting the heat spot in the direction of an arrow D4 from the position in which the greatest pressing force is exerted by the platen 31. This eventually makes it possible to form an image satisfactorily.

While specific embodiments of the invention have been described, the invention is not limited to these embodiments, and various changes can be made therein without departing from the gist of the invention.

The base 10 may be used as an ink-jet head provided with a top plate with holes, for example. When the base 10 is used as the ink-jet head, it is possible to ensure electrical reliability adequately even when pressure associated with a shot of an ink or fluid pressure of an ink is applied.

As for the conductive layer 14, for example, the first lower layer 141*a* and the first upper layer 141*b* may be formed of the same formation material, or the second lower layer 142*a* and the second upper layer 142*b* may be formed of the same formation material.

Figure 11A:
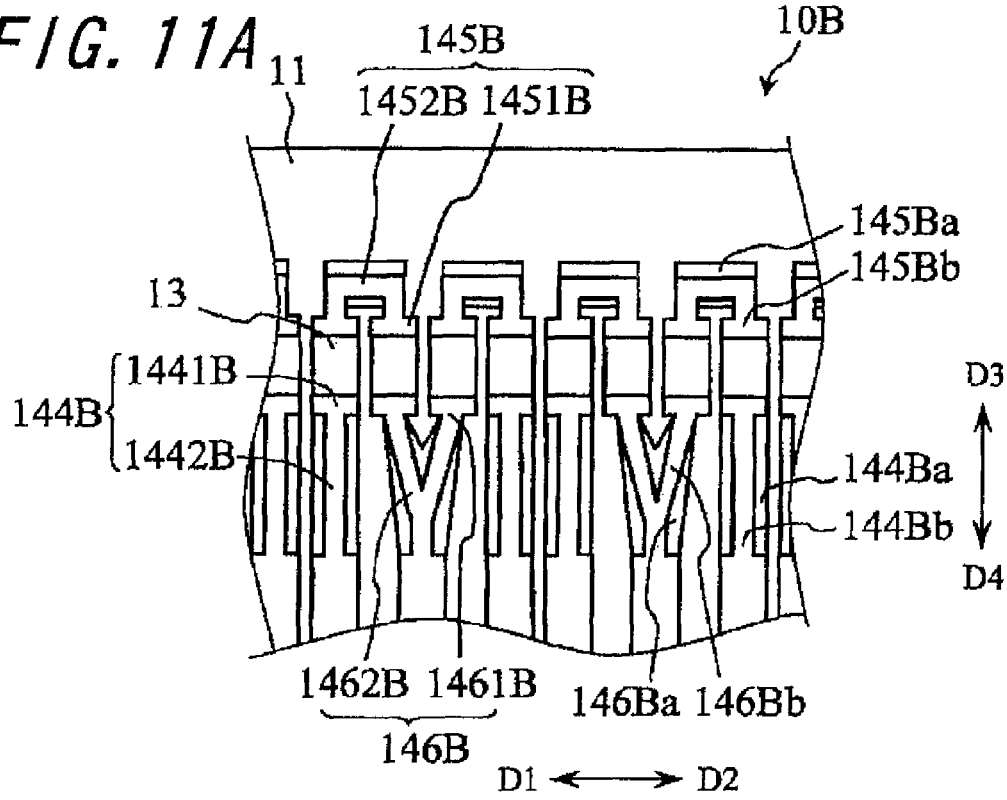
FIG. 11 is a diagram showing a modified example of a first conductive layer of the thermal head shown in FIG. 1.
Figure 11B:
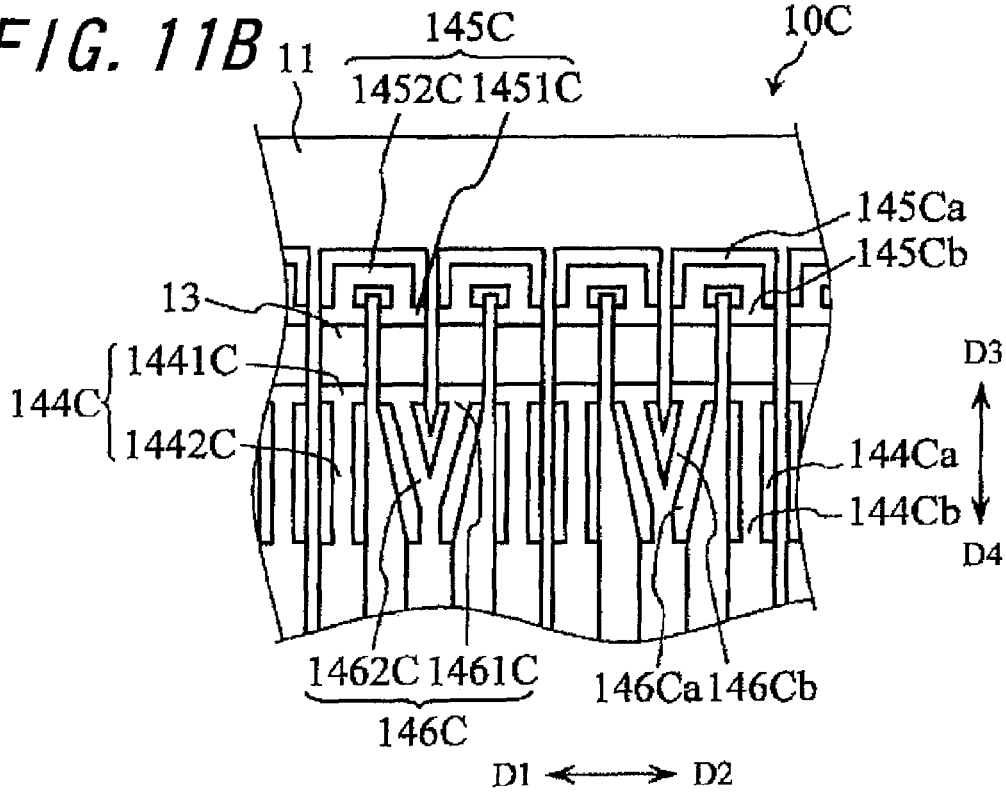

As shown in FIG. 11A, in the conductive layer 14, a conductive layer 14B, for example, may include an electrode 144B electrically connected to the driving IC 20, an electrode 145B electrically connecting two heat generating parts 131, and an electrode 146B supplying power to two heat generating parts 131. Moreover, as shown in FIG. 11B, a conductive layer 14C may include an electrode 144C electrically connected to the driving IC 20, an electrode 145C electrically connecting two heat generating parts 131, and an electrode 146C supplying power to two heat generating parts 131.

Figure 12A:
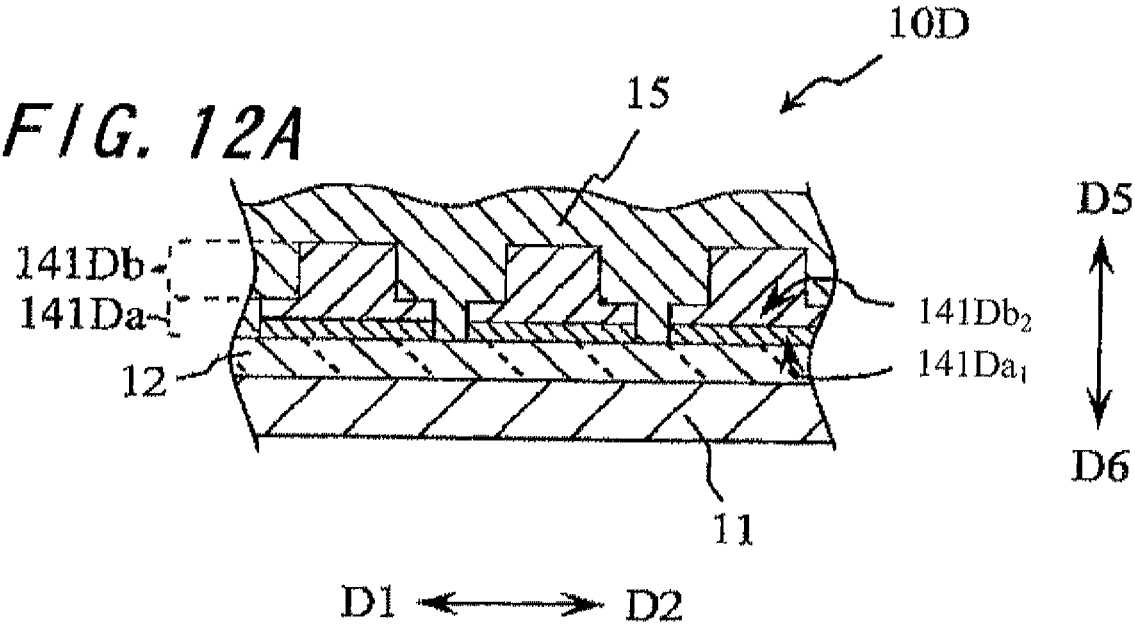
FIG. 12 is a diagram showing a modified example of the first conductive layer of the thermal head shown in FIG. 1.

As shown in FIG. 12A, the first conductive layer 141 may be so configured that a first lower layer 141Da includes a first layer 141$Da_1$ and a second layer 141$Db_2$ formed of a formation material which is different from the material for the first layer 141$Da_1$, the second layer 141$Db_2$ formed integrally with a first upper layer 141Db. With such a structure, it is possible to make greater the area of contact between the parts formed of different materials, resulting in an increase in adhesion between the parts formed of different materials in the first wiring part. Therefore, in the thermal head with such a structure, it is possible to reduce the separation between the parts formed of different materials in the first wiring part, and thereby enhance electrical reliability. Moreover, such a structure may be adopted in the second conductive layer.

Figure 12B:
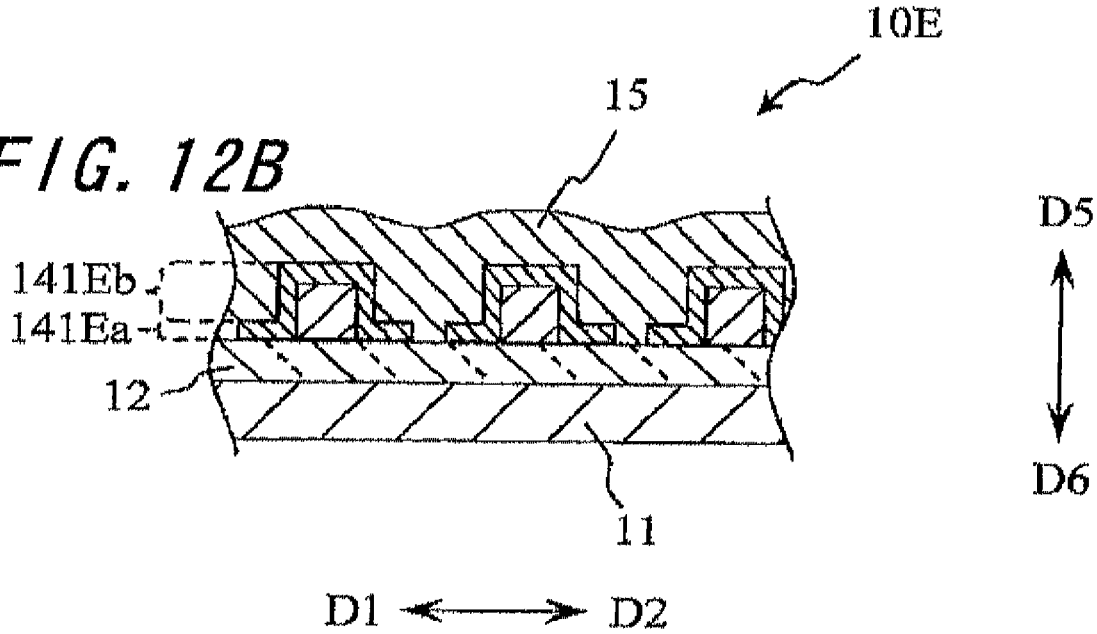

As shown in FIG. 12B, a first lower layer 141Ea and a first upper layer 141Eb may be formed integrally by using a plurality of constituent materials. Also with such a structure, it is possible to make greater the area of contact of each constituent material. This makes it possible to enhance the adhesion of the first lower layer 141Ea to the first upper layer 141Eb, and enhance electrical reliability. Moreover, such a structure may be adopted in the second conductive layer.

Figure 13:
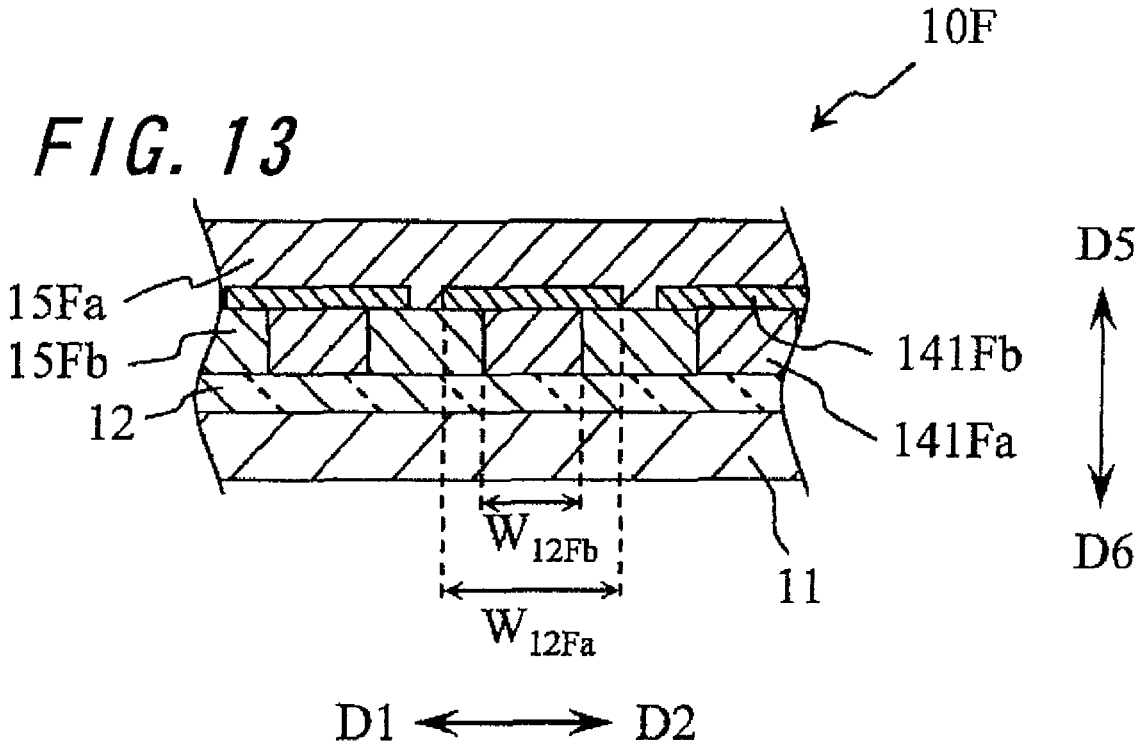
FIG. 13 is a diagram showing a modified example of a conductive layer of the thermal head shown in FIG. 1.

As shown in FIG. 13, the width $W_{12b}$ of the first upper layer 141*b* in a plan view may be so configured that the width $W_{12Fb}$ of a first upper layer 141Fb in a plan view is greater than the width $W_{12Fa}$ of a second lower layer 141Fa in a plan view.

Incidentally, the base 10 with such a structure can be formed by, for example, laying protective layers 15Fa and 15Fb, forming a resin layer in the first lower layer 141Fa, or providing the first lower layer 141Fa with electrical insulation.

The conductive layer 14 in accordance with the embodiments is so configured that the first conductive layer 141 includes the first lower layer 141*a* and the first upper layer 141*b* and the second conductive layer 142 includes the second lower layer 142*a* and the second upper layer 142*b*; however, the structure is not limited thereto. Three or more electrodes may be disposed in such a way that they overlap one another.

Figure 14A:
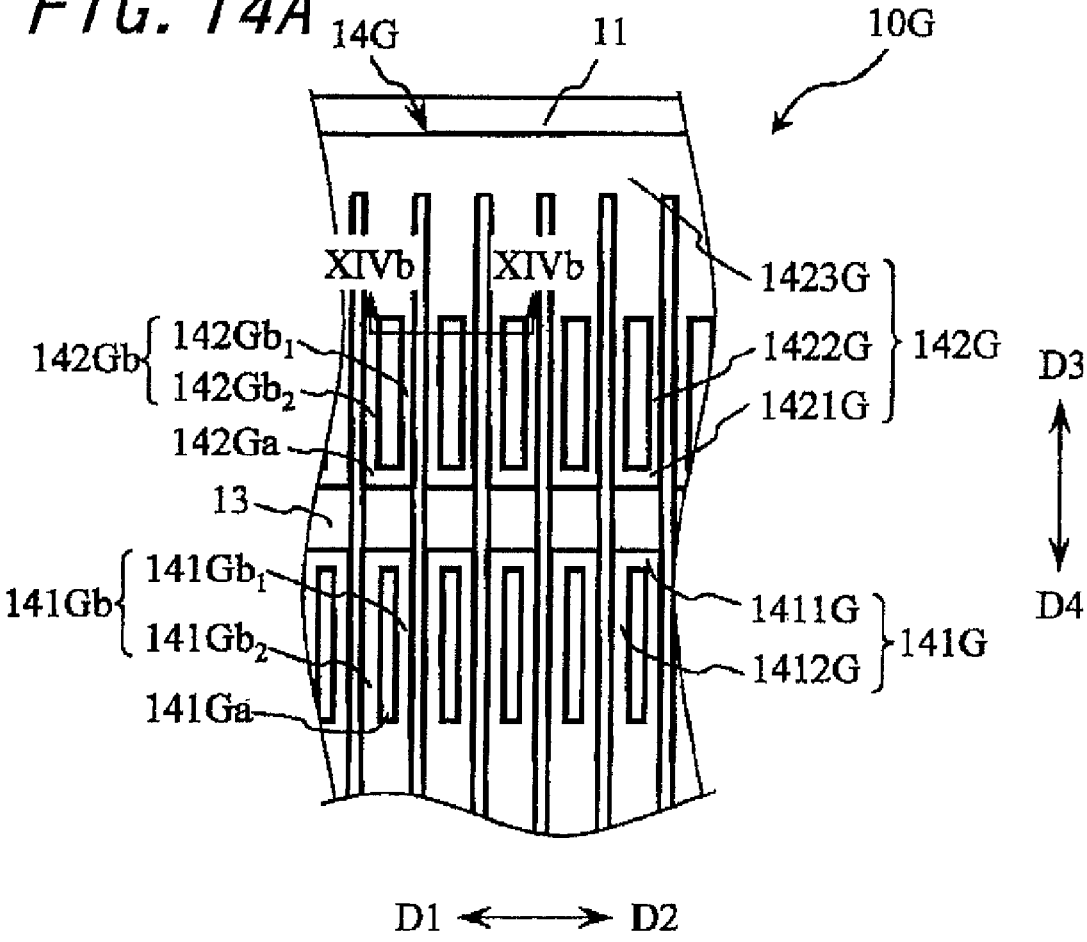
FIG. 14A is a plan view showing a modified example of the conductive layer of the thermal head shown in FIG. 1.
Figure 14B:
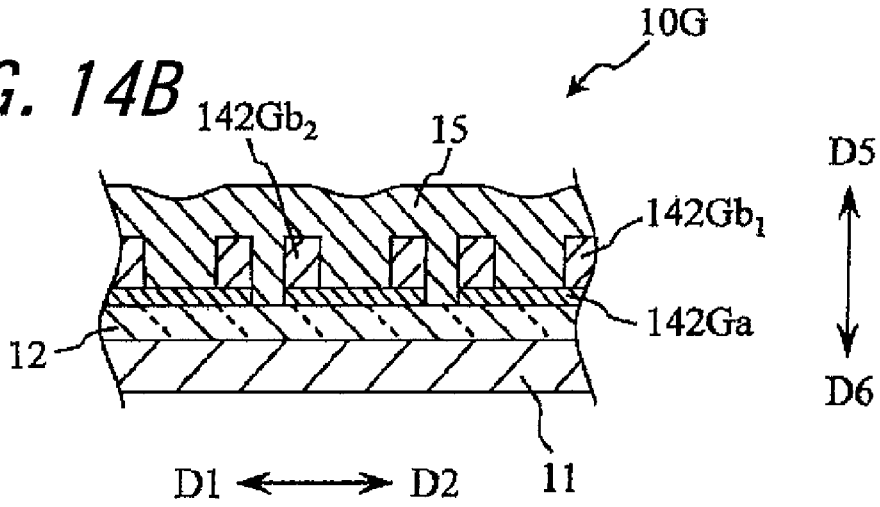
FIG. 14B is a sectional view taken on line XIVb-XIVb shown in FIG. 14A.

As shown in FIG. 14, the first conductive layer 141 and the second conductive layer 142 may be so configured that a first upper layer 141Gb and a second upper layer 142Gb include first conducting paths 141$Gb_1$ and 142$Gb_1$, respectively, and second conducting paths 141$Gb_2$ and 142$Gb_2$, respectively, which are electrically parallel to the first conducting paths 141$Gb_1$ and 142$Gb_1$.

With such a structure, even when any one of the first conducting paths 141$Gb_1$ and 142$Gb_1$ or any one of the second conducting paths 141$Gb_2$ and 142$Gb_2$ is cut off, it is possible to ensure predetermined electrical conduction by the remaining one conducting path. Thus, this structure is suitable for enhancing electrical reliability in the wiring part.

When lower layers 141Ga and 142Ga extend between the first conducting paths 141Gb1 and 142Gb1 and the second conducting paths 141Gb2 and 142Gb2 in a plan view, there is no need to provide regions of the lower layers 141Ga, and 142Ga, the regions whose widths in a plan view are greater than those of the upper layers 141Gb and 142Gb, outside the upper layers 141Gb and 142Gb. This makes it possible to narrow the pitch of the heat generating parts 131. In such a case, the width in a plan view in a first wiring part 1412G and a second wiring part 1422G is the sum of the widths of the first conducting paths 141Gb1 and 142Gb1 and the second conducting paths 141Gb2 and 142Gb2 in a plan view in the first wiring part 1412G and the second wiring part 1422G.

In the thermal head X1, for example, the resistor layer 13 may be formed integrally with at least one of the first lower layer 141*a* and the second lower layer 142*a*. With such a structure, it is possible to connect the lower layers 141*a* and 142*a* in the heat generating part 131 and the conductive layer 14 electrically satisfactorily. Thus, this structure is suitable for enhancing electrical reliability.

Figure 15:
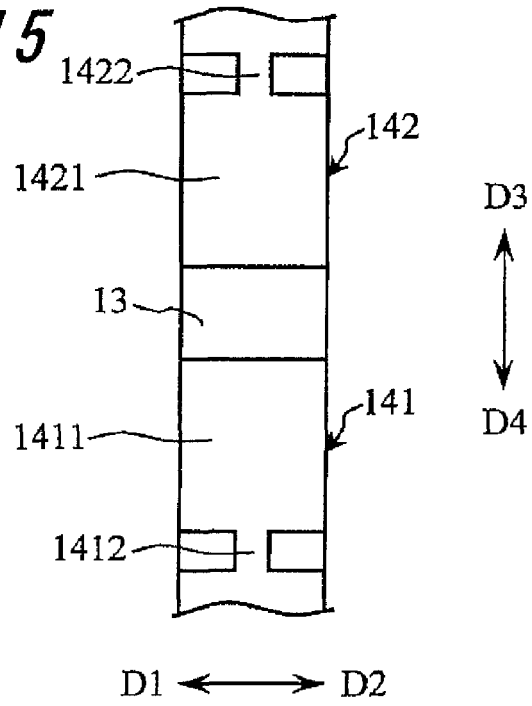
FIG. 15 is a diagram showing a modified example of the first conductive layer of the thermal head shown in FIG. 1.

As shown in FIG. 15, the first and second conductive layers 141 and 142 in the thermal head X1 may be so configured that the dimensions in the first and second connecting parts 1411 and 1421 in the directions of arrows D3 and D4 are greater than the dimensions in the first and second wiring parts 1412 and 1422 in the directions of arrows D3 and D4.

Figure 16:
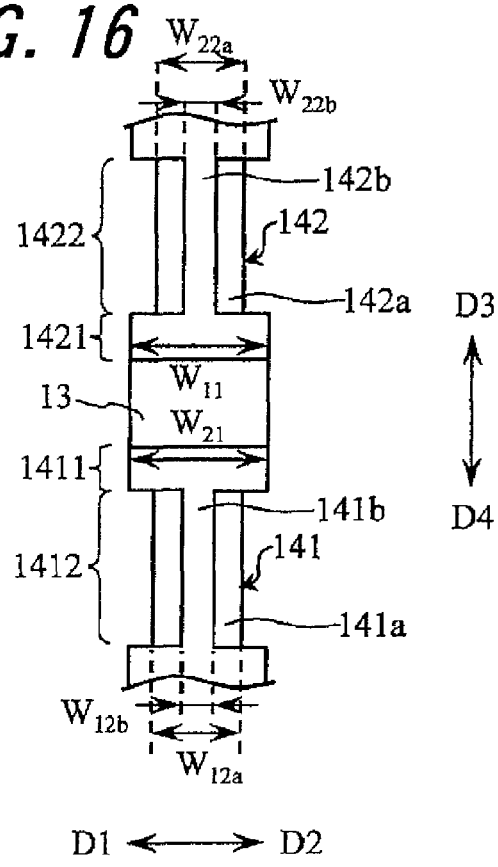
FIG. 16 is a diagram showing a modified example of the first conductive layer of the thermal head shown in FIG. 1.

As shown in FIG. 16, the first and second conductive layers 141 and 142 in the thermal head X1 may so configured that the widths in a plan view in the first and second wiring parts 1412 and 1422 are smaller than the widths W11 and W21 in a plan view in the first and second connecting parts 1411 and 1421. In this case, the first and second upper layers 141*b* and 142*b* in the conductive layer 14 are so configured that the widths W12*b* and W22*b* in a plan view in parts corresponding to the wiring parts 1412 and 1422 are smaller than the widths $W12_a$ and W22*a*, of the first and second lower layers 141*a* and 142*a* in a plan view.

The invention claimed is:

1. A recording head comprising:

a substrate;

a plurality of heat generating parts arranged on or above the substrate; and a conductive layer electrically connected to each of the heat generating parts, wherein the conductive layer includes a connecting part electrically connected to the heat generating parts and a wiring part electrically connected to the connecting part, the wiring part having a smaller cross-sectional area along an arrangement direction of the heat generating parts, than a cross-sectional area of the connecting part along the arrangement direction of the heat generating parts, the wiring part includes a first part having a smaller width in a plan view along the arrangement direction of the heat generating parts, than a width of the connecting part in a plan view along the arrangement direction of the heat generating parts, and a second part located in such a way that at least part thereof overlaps with the first part, the second part having a greater width in a plan view along the arrangement direction of the heat generating parts, than the width of the first part in the plan view of the arrangement direction of the heat generating parts and wherein an entirety of the first part is located on the second part.

2. The recording head of claim 1, wherein the width of the second part in the plan view along the arrangement direction is equal to or smaller than the width of the connecting part in the plan view along the arrangement direction.

3. The recording head of claim 1, wherein the second part includes a first layer and a second layer which is formed of a material different from a material for the first layer and formed integrally with the first part.

4. The recording head of claim 1, wherein the first part includes a first conducting path and a second conducting path which is electrically parallel to the first conducting path.

5. The recording head of claim 4, wherein the second part extends between the first conducting path and the second conducting path in the plan view.

6. The recording head of claim 1, wherein the wiring part comprises a plurality of the wiring parts, the conductive layer further includes a common connecting part to which each of the plurality of the wiring parts is connected, and the second parts of the respective wiring parts are connected to one another situated next thereto in the arrangement direction of the heat generating parts, at ends thereof connected to the common connecting part.

7. The recording head of claim 1, wherein the wiring part comprises a plurality of the wiring parts, the conductive layer further includes a common connecting part to which each of the plurality of the wiring parts is connected, and the common connecting part has a smaller thickness between ends thereof connected to the wiring parts situated next to one another in the arrangement direction of the heat generating parts, than a thickness of a region of the end thereof connected to the first part of the wiring part.

8. The recording head of claim 1, further comprising a plurality of transmitting parts each having an end connected to the wiring part, wherein the wiring part has a smaller cross-sectional area along the arrangement direction of the heat generating parts at an end thereof connected to the connecting part, than a cross-sectional area along the arrangement direction of the heat generating parts at an end of the connecting part connected to the heat generating part, and has a greater cross-sectional area along the arrangement direction of the heat generating parts at an end thereof connected to the transmitting part, than the cross-sectional area along the arrangement direction of the heat generating parts at the end of the connecting part connected to the heat generating part, and the transmitting part includes, at an end thereof connected to the wiring part, a lower layer having a greater width in a plan view than the width of the first part in the plan view, and an upper layer located on the lower layer and having a width in a plan view almost a same as the width of the first part in the plan view.

9. The recording head of claim 1, wherein the conductive layer includes a first conductive layer connected to one end of the heat generating part and a second conductive layer connected to another end of the heat generating part, and a cross-sectional area of the wiring part in the first conductive layer along the arrangement direction of the heat generating parts, is smaller than a cross-sectional area of the wiring part in the second conductive layer along the arrangement direction of the heat generating parts.

10. The recording head of claim 9, wherein a width of the first part of the connecting part in a plan view along the arrangement direction is the same as a width of the second part of the connecting part in a plan view along the arrangement direction.

11. The recording head of claim 9, wherein the second part of the connecting part is formed integrally with the heat generating part and the second part of the wiring part.

12. The recording head of claim 9, wherein the first part of the connecting part is formed integrally with the first part of the wiring part.

13. A recording apparatus comprising the recording head of claim 1 and a transport mechanism that transports a recording medium.

14. The recording head of claim 1, wherein the connecting part has a first part and a second part, and the first part of the connecting part is located on the second part of the connecting part.

* * * * *

UNITED STATES PATENT AND TRADEMARK OFFICE

CERTIFICATE OF CORRECTION

PATENT NO. : 8,279,248 B2
APPLICATION NO. : 12/680727
DATED : October 2, 2012
INVENTOR(S) : Moto It is certified that error appears in the above-identified patent and that said Letters Patent is hereby corrected as shown below:

On the Title Page at line (75) the Inventors Section, please correct the fifth inventor's name Yoshira Niwa. It should read Yoshihiro Niwa.

Signed and Sealed this
Twelfth Day of February, 2013

Teresa Stanek Rea
*Acting Director of the United States Patent and Trademark Office*